United States Patent [19]

Harper et al.

[11] 4,385,611

[45] May 31, 1983

[54] FUEL INJECTION SYSTEM WITH FUEL MAPPING

[75] Inventors: Peter W. Harper, Ramonville St. Agne, France; Mark C. Harvey, Yorktown, Va.

[73] Assignee: The Bendix Corporation, Southfield, Mich.

[21] Appl. No.: 249,771

[22] Filed: Apr. 1, 1981

[51] Int. Cl.[3] ..... F02B 3/00

[52] U.S. Cl. ..... 123/480; 123/491; 123/492; 123/493

[58] Field of Search ..... 123/480, 488, 494, 491, 123/492, 493

[56] References Cited

U.S. PATENT DOCUMENTS

| | | | |
|---|---|---|---|
| 3,881,453 | 5/1975 | Harper et al. | 123/494 |
| 4,107,717 | 8/1978 | Klotzner et al. | 123/480 |
| 4,148,283 | 4/1979 | Harada et al. | 123/492 |
| 4,176,625 | 12/1979 | Stauffer | 123/493 |
| 4,214,307 | 7/1980 | Peterson, Jr. et al. | 123/480 |
| 4,235,204 | 11/1980 | Rice | 123/488 |
| 4,238,813 | 12/1980 | Carp et al. . | |
| 4,240,390 | 12/1980 | Takeda | 123/480 |

*Primary Examiner*—Parshotam S. Lall
*Attorney, Agent, or Firm*—Russel C. Wells; Markell Seitzman

[57] ABSTRACT

A digital-analog fuel injection system wherein fuel lean out is controlled by a fuel mapping circuit 36 which provides one of sixteen levels of percent lean out control of the fuel pulse width supplied to an injector. In order to provide an immediate update of the engine demands, a pulse generation circuit 72 operates in real time. The fuel mapping circuit 36 provides corrections to the pulse generating circuit on a sampled update basis. This is accomplished by using a digital word 34 generated by a microprocessor 10 to control a multiplying digital to analog converter whose reference input is an electrical signal ($V_{MAP}$) representing the present manifold pressure and an offset voltage ($V_O$) accounting for the several variable of the system such as the engine, injectors and pressure sensor. The output signal ($V_B$) from the fuel mapping circuit 34 is then applied to a pulse generating circuit 72 to control the generation of fuel pulse width which is being applied to a fuel injector driver 46 (FIG. 5).

6 Claims, 6 Drawing Figures

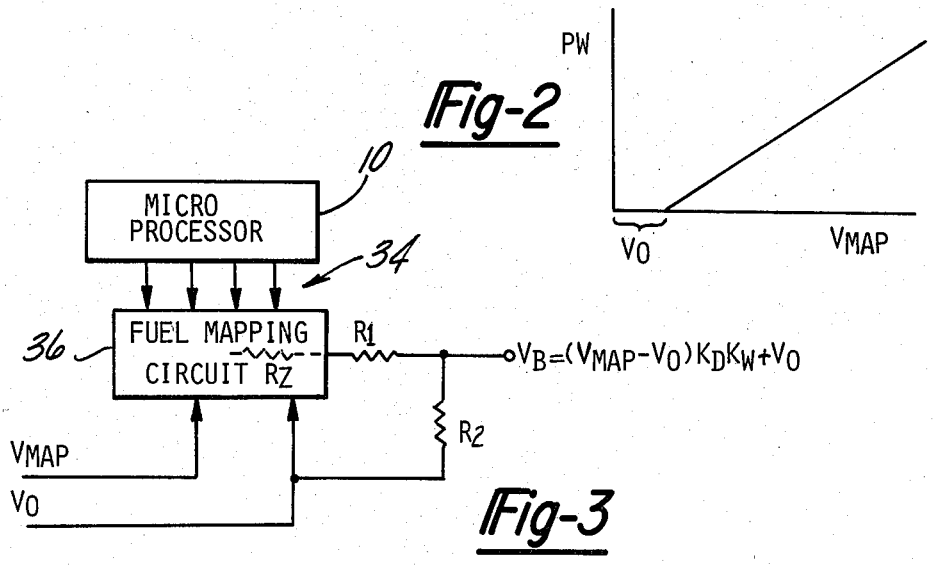
Fig-2
Fig-3
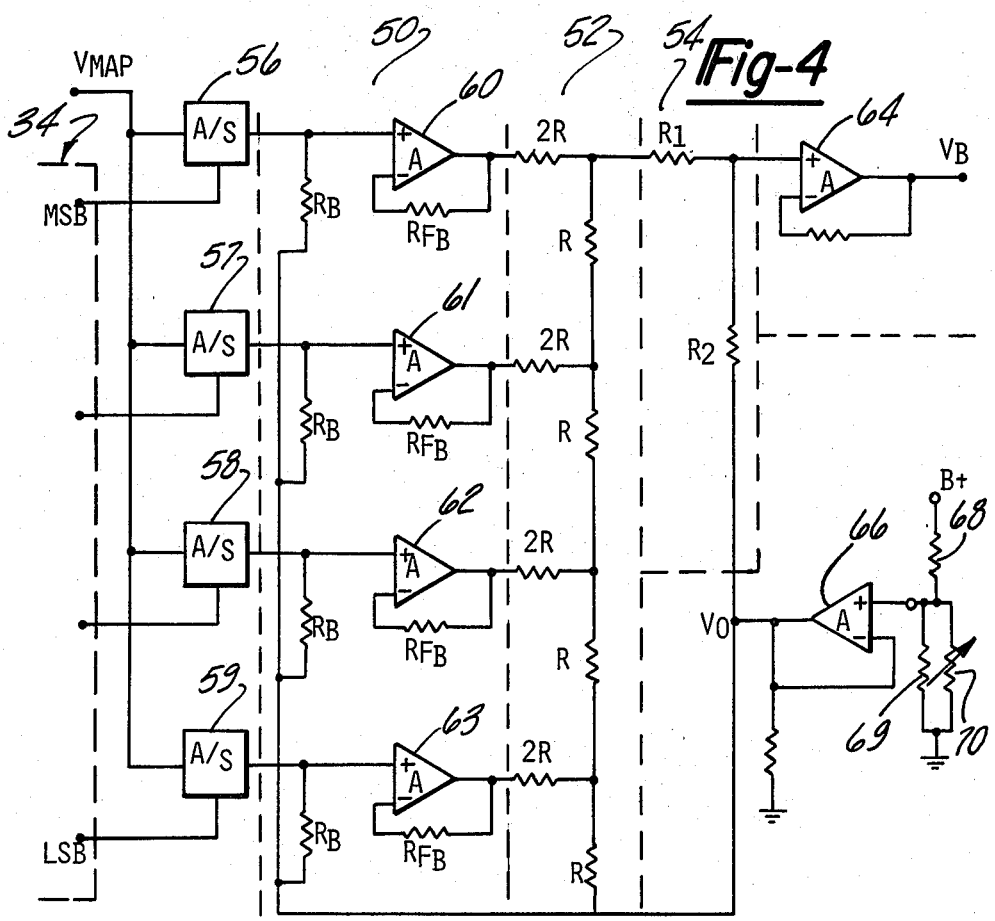
Fig-4

FUEL INJECTION SYSTEM WITH FUEL MAPPING

BACKGROUND OF INVENTION

The basic technique employed in speed density electronic fuel injection systems for generating fuel injector actuation pulses uses a pulse forming circuit having a capacitive timing network measuring the time difference along a charge curve between a real time voltage, $V_{MAP}$, a function of manifold pressure and an initial voltage, $V_{RPM}$, a function of engine speed. This is accomplished by setting the initial voltage, $V_{RPM}$, on the capacitor and then applying a charging current to the capacitor so that the capacitor charges linearly with time. This waveform is applied to one input of a differential comparator with the voltage $V_{MAP}$ applied to the other input. The comparator pulse output or fuel pulse width (P.W.), is then proportional to the difference of the two voltages, the charging current, and the value of the capacitor according to the following equation:

$$P.W. = \frac{(V_{MAP} - V_{RPM})\,C}{I}$$

The initial condition $V_{RPM}$ has traditionally been derived by switching several current sources or current sinks, and voltage clamps to the timing capacitor during the engine revolution prior to the beginning of the charging current. These current supplies and voltage clamps are switched on a fixed time basis so that as the engine speed increases the initial voltage on the capacitor will vary accordingly. If the current supplies and voltage clamps are fixed values the resulting RPM correction is incremental. If they are a function of the voltage $V_{MAP}$ the resulting correction is a percent change in pulse width. The disadvantage of this technique is that many analog circuits are needed to correct for fuel variations required by engine speed variation. However, the correction at best does not include any minor volumetric corrections due to manifold pressure.

Digital mapping techniques have evolved to allow individual pulse width computation for all MAP/RPM combinations. Typically, the pulse width is stored in a three dimensional lookup table memory. The table is addressed by MAP, RPM and the pulse width is read. This technique involves making A/D conversions, and interpolating data since the memory is of a finite size. However, the time required to do the conversions, read and interpolate pulse width data, and generate the pulse is normally too long to achieve the proper real time pressure information update which is inherent in the analog approach.

These disadvantages are corrected by a fuel mapping circuit which combines the advantage of the analog circuit to perform real time update of pressure information and the digital circuits ability to perform complicated matrix-type mapping. This is achieved by using an analog pulse generator in conjunction with a microprocessor which performs the matrix lookup of a percent correction to the pulse width.

There is thus described herein a means to obtain complex digital fuel mapping of pulse width versus pressure and RPM without fully sacrificing real time pressure information update. The basic pulse width versus pressure response is generated by the traditional approaches of comparing a linear time base ramp to a voltage proportional to pressure. In this system, the initial voltage on the capacitor is controlled by a digital microprocessor via a differential multiplying digital to analog converter. A digital word map with RPM and pressure is stored in the microprocessor. This digital word is converted to a percent correction of pulse width by the DAC and the pulse generating circuit. The system result, therefore, is a complete mapping of fuel requirement versus pressure and RPM.

SUMMARY OF INVENTION

There is described a fuel injection system with fuel mapping for energizing a plurality of fuel injectors with an updated control of the fuel pulse width. To the well known fuel injection system having a plurality of sensors responding to various engine operating conditions and generating electrical signals, a microprocessor is adapted to receive such signals and applying certain ones to a three dimensional look-up table and generating a digital word representing a desired pulse width correction for application to an injector. This digital word is supplied to a multiplying digital to analog converter where the bits of the word are modified by manifold pressure and operate to control the fuel pulse width generator to lean out or shorten the desired fuel pulse width.

DESCRIPTION OF DRAWINGS

In the drawings:

FIG. 2 is a graph of the fuel pulse width transfer function.

FIG. 3 is a block diagram of the fuel mapping circuit of FIG. 1.

FIG. 4 is the schematic of the circuit of FIG. 3.

DETAILED DESCRIPTION

Figure 1:
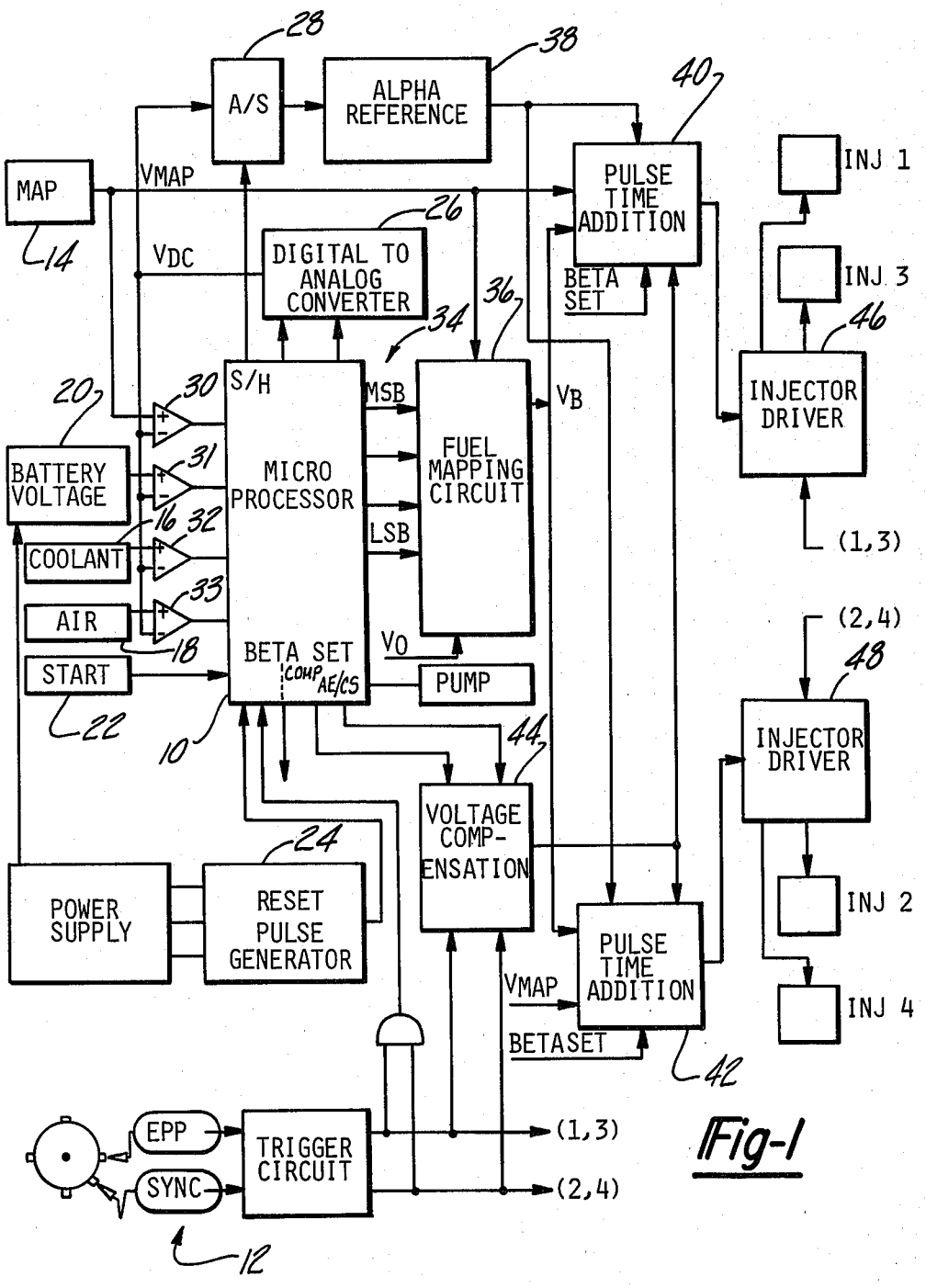
FIG. 1 is a block diagram of the preferred embodiment of a fuel injection system.

This invention relates to a fuel injection system with fuel mapping. FIG. 1 is a block diagram of a preferred embodiment of a microprocessor based, fuel injection system with fuel mapping for a four cylinder internal combustion engine utilizing sequential fuel injection. The sequential timing portion of this circuit may be that as disclosed in co-pending patent application of Peter Harper entitled "Quadrature Trigger System for Sequential Fuel Injection" which is being filed concurrently herewith and is expressly incorporated herein by reference. This trigger system is a binary encoded system wherein the number of sequential events is equal to 2n where n is the number of switch assemblies required and comprises a cam, two proximity sensors and a trigger circuit for generating and distributing four pulses, one for each individual sequential event. The two proximity sensors may be hall-effect devices which are positioned ninety degrees apart and in sensing relationship to the periphery of the single lobe cam. Each sensor will generate a binary one valued signal for one-half of an engine cycle and will overlap each other for one-quarter of an engine cycle.

Another type of trigger system may be that disclosed in U.S. Pat. No. 3,881,453 entitled "Electronic Fuel Injection Triggering Means" which is issued to Peter Harper et al., wherein two switches are used inasmuch as this embodiment is for a four cylinder engine. This patent is expressly incorporated herein by reference. The trigger system generates a pulse on either the leading or trailing edge of each switch actuation and decodes the pulses to identify which injector should be actuated. Each pulse is also inputted to the microprocessor 10.

The microprocessor 10 receives in addition to the pulses from the trigger system 12, inputs from sensors sensing manifold pressure 14 (MAP), coolant temperature 16, air temperature 18 and signals indicating the present battery voltage 20, start conditions 22 and reset conditions 24. The sensing of the battery voltage at a particular time instant controlled by the microprocessor is a feature of this system that is accomplished by the digitally reading out, along a bus line of the microprocessor, an eight bit digital word to the digital to analog converter 26 or DAC. The DAC 26 generates an analog signal, $V_{DC}$ which is supplied as an input to a bilateral switch 28 controlled by the microprocessor 10, and to the inverting input of a plurality of comparators 30–33. The analog voltage outputs of the three sensors 14, 16, 18 and the battery voltage sensing 20 of this embodiment are converted by comparators to digital inputs to the microprocessor 10 under the control of the DAC 26.

This is accomplished by the classical successive eight step approximation technique of analog to digital conversion. In each case the microprocessor 10 identifies the particular input desired and with each bit of the digital word outputted to the DAC, the DAC generates an analog voltage which supplied to the inverting input of the corresponding comparator. If the voltage from the sensor is higher than the output of the DAC, a binary one is written into the microprocessor and if it lowers than a binary zero is written into the microprocessor. After eight steps, a digital word is stored in the microprocessor which represents the sensed value of the particular sensor. Thus the analog voltage output from the sensor is converted to a digital word by the cooperation of the microprocessor 10, the DAC 26 and the particular comparator 30–33.

The microprocessor 10 generates several output signals to control the operation of the fuel injection system. One such output is a four bit digital word or a "nibble" 34, which in the preferred embodiment is supplied to a fuel mapping circuit 36 for providing sixteen levels of lean-out control for the fuel pulse, wherein each level will shorten the pulse width by a predetermined percent. Another output signal, S/H of the microprocessor 10 is a signal for gating $V_{DC}$ from the DAC to the alpha reference current source 38 to supply current to both of the pulse time addition circuits 40 and 42. Further, the microprocessor 10 will generate a signal to a voltage compensation circuit 44 for adjusting the fuel pulse width according to the magnitude of the supply voltage to the injector driver circuits 46 and 48.

The two pulse time addition circuits 40 and 42 are each adapted to generate the desired fuel pulse to a selected injector driver 46 or 48 to actuate its corresponding injector. The fuel pulse width generation is fundamentally explained in U.S. Pat. No. 3,734,068 issued to Junuthula N. Reddy for "Fuel Injection Control System" on May 22, 1973 which is expressly incorporated herein by reference, and is by means of charging a control capacitor to intercept a voltage level $V_{MAP}$ generated by the manifold pressure sensor. In particular in FIG. 1, the fuel pulse width is generated in the pulse time addition circuits 40 or 42 wherein acceleration enrichment, cold start, voltage compensation and the output from the fuel mapping circuit are applied to the basic fuel pulse. The pulse time addition circuits are described in U.S. Pat. No. 4,176,625 entitled "Pulse Time Addition Circuit For Electronic Fuel Injection Systems," issued to R. L. Stauffer, which is expressly incorporated herein by reference.

In addition, the real time control, $V_{MAP}$, is supplied to the fuel mapping circuit 36 for generating lean-out control to the fuel pulse width. Utilizing the capabilities of the microprocessor 10 to form matrix look-up for the proper MAP and RPM conditions for the fuel mapping circuit, each fuel pulse is individually, correctly and properly adjusted for the particular condition of the engine at the time of injection and not at some time previous thereto as in previous systems.

The microprocessor 10 is programmed with at least one look-up table wherein the coordinates of the table are manifold pressure or MAP and engine speed or RPM. It can be appreciated that various speeds and different manifold pressures will indicate different operating conditions of the engine and therefore different fuel demands by the engine. In the preferred embodiment, the table comprises four manifold pressure points and some fifteen to twenty speed points giving a total of from sixty to eighty look-up points. The microprocessor 10 addresses the look-up table and as a result generates the nibble 34 for the fuel mapping circuit 36.

In a fuel injection system, the amount of fuel to be injected is proportional to the width of the fuel pulse according to the basic equation:

$$P.W. = \frac{(V_{MAP} - V_{RPM})\,C}{I} \tag{1}$$

$$P.W. = \frac{CV_{MAP}}{I} - \frac{CV_{RPM}}{I} \tag{2}$$

The fuel mapping circuit 36 herein is used to modify the $V_{RPM}$ term with the nibble 34 from the microprocessor 10 and since this term is subtracted in equation (2), the output of fuel mapping circuit operates as a lean-out control. As previously stated $V_{MAP}$ is a real time input to the fuel mapping circuit, therefore the output signal is defined as:

$$V_B = (V_{MAP} - V_O)K_D K_W + V_O \tag{3}$$

Combining equations 2 and 3 and rearranging, the result is:

$$P.W. = V_{MAP}\frac{C}{I} - [(V_{MAP} - V_O)K_D K_W + V_O]\frac{C}{I} \tag{4}$$

or:

$$P.W. = (V_{MAP} - V_O)(1 - K_D K_W)\frac{C}{I} \tag{5}$$

Where: $K_W$ is the bit weight constant and is defined as:

$$K_W = R_2/(R_1 + R_2 + R_Z) \tag{6}$$

where $R_1$, $R_2$, and $R_Z$ are defined herein below.

$K_D$ is derived from the nibble 34 and since the nibble is a four bit word having sixteen variations or levels, $K_D$ has a value from zero to:

$$2^n - 1/2^n = 0.9375 \tag{7}$$

wherein n is the number of bits in a word.

The fuel mapping circuit 36 is a multiplying digital to analog converter for controlling the percent of lean-out control. Lean-out control is a step function wherein the percentage of each step is determined by a proper ratio of several resistors in the fuel mapping circuit 36. Referring to FIG. 3 there is a block diagram of the fuel mapping circuit of the preferred embodiment. One input to the fuel mapping circuit is the nibble 34, the second input is the analog voltage, $V_{MAP}$ and a third input is an offset voltage $V_o$ which is determined by a characteristic of the engine. The output signal $V_B$ of the fuel mapping circuit is taken from a voltage divider circuit comprising resistors $R_1$ and $R_2$ and a function of the output impedance of the fuel mapping circuit 36 indicated by the phantom resistor $R_z$ shown in FIG. 3.

FIG. 4 is a detailed schematic of the fuel mapping circuit 36 comprising a voltage multiplexer 50, the 2R/R ladder 52 and the bit weight divider 54. The voltage multiplexer 50 supplies a voltage which is a function of $V_{MAP}$ and $V_O$ to the inputs of the 2R/R ladder 52 according to the status of the nibble 34 which controls the analog switches 56–59. The function of the 2R/R ladder circuit is to generate an analog voltage $V_B$ which is proportional to the multiplication of the quantity $(V_{MAP}-V_O)$ by the four bits of the nibble.

Each bit of the nibble 34 is supplied as a control signal to an analog switch 56–59 wherein the signal to be switched is $V_{MAP}$. The output signal of each switch is a voltage signal which is supplied to the noninverting input of each of a plurality of operational amplifiers 60–63 configured as a unity gain buffers. Also connected to the noninverting input of each operational amplifier is a pull-down resistor, $R_B$ which is connected between the output of the switch and the offset voltage $V_O$. The output of each operational amplifier 60–63 is fedback to the inverting input of the amplifier through resistor $R_{FB}$ and also is supplied to the 2R/R ladder circuit 52. The output of the ladder circuit is supplied through the voltage divider circuit comprising resistors $R_1$ and $R_2$ to the noninverting input of another operational amplifier 64 also configured as a unity gain buffer to generate the signal $V_B$.

The purpose of the offset voltage $V_O$ is to modify the transfer function of fuel pulse width verses manifold pressure for the variables of the system such as the engine, the injectors and the pressure sensor and is illustrated in FIG. 2. The offset voltage is generated by means of an operational amplifier 66 wherein the noninverting input is connected to a source of voltage through a resistor 68 and to ground through a two parallel resistors 69 and 70 one of which is an adjustable trim resistor 70. The output voltage $V_O$ of the operational amplifier 66 is fedback directly to the inverting input of the amplifier. Depending upon the ratio of the resistors, the offset voltage can be any valued desired in accordance with the variables in the system. Each system may have a different characteristic and for one particular system the value of $V_O$ is 0.5 volts. If the offset voltage is any value other than zero, than a differential multiplying digital to analog converter is used. However, if the value of the offset voltage is zero than a non-differential multiplying digital to analog converter is used. The fuel mapping circuit 36, as illustrated in FIG. 4 will operate for any value of $V_O$.

The input circuit to the digital to analog converter for each bit of the digital word is identical. The following table illustrates the value of the several resistors in FIG. 4.

| | |
|---|---|
| $R_1$ | 24K |
| $R_2$ | 22.1K |
| R | 23K |
| 2R | 46K |
| $R_B$ | 57K |
| $R_{FB}$ | 8K |
| $R_Z$ | 23K |

Putting these values into the equation number (6):

$$K_W=R_2/(R_1+R_2+R_Z)$$

the value of $K_W$ is 0.32 which when multiplied with $K_D$, the bit weight constant, results in a 2% bit resolution for each level, thereby giving the preferred embodiment a range of lean-out control from 0 to 30%.

In the microprocessor 10, the battery voltage 20 is continually monitored and in response to changes in the battery voltage, a signal, COMP, is generated from the microprocessor to the voltage compensation circuit 44 which causes adjustment of the injector pulse width. In the preferred embodiment the battery voltage is less than a predetermined nominal voltage value, therefore, the voltage compensation circuit 44 will function to lengthen the fuel pulse width signal from that length which is calculated at the nominal voltage.

Figure 5:
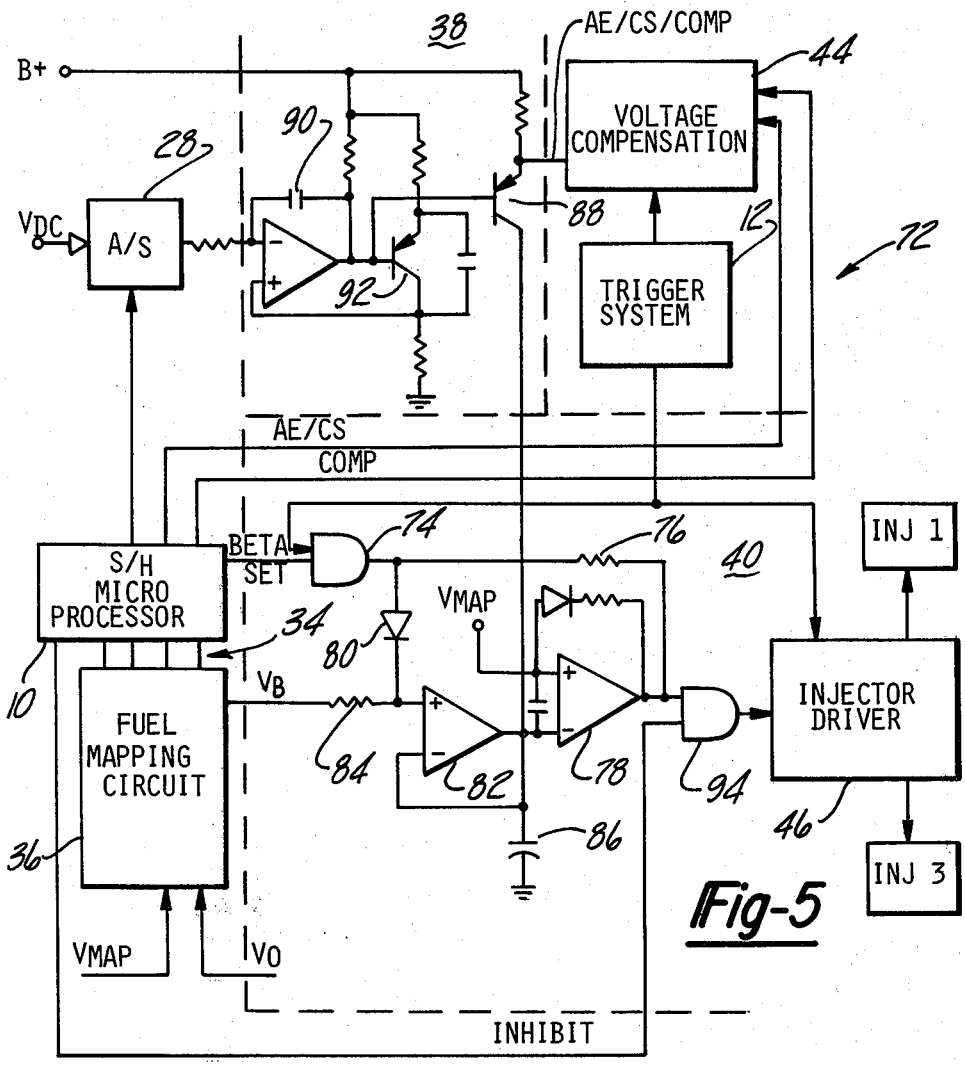
FIG. 5 is a schematic of the pulse width generation circuit.
Figure 6:
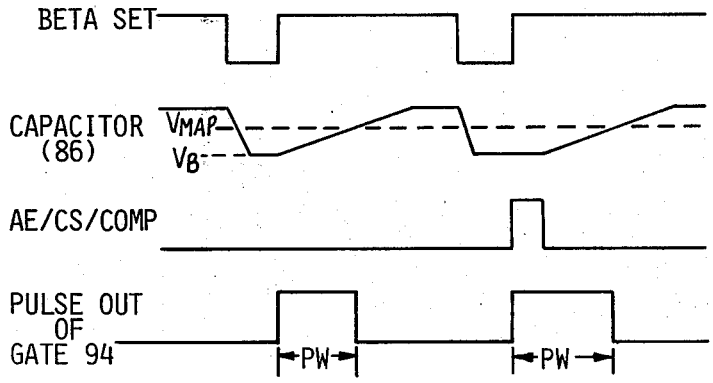
FIG. 6 is a timing diagram of FIG. 5.

In a similar manner, the microprocessor 10 will generate an acceleration enrichment signal A/E when the engine demands such enrichment. As acceleration enrichment is an addition of fuel, such addition is accomplished by lengthening the pulse width. In a similar manner during cold start the engine typically needs more fuel and the microprocessor generates a signal to the voltage compensation circuit 44 to lengthen the pulse width. For cold start, the signal generated is CS and the microprocessor working in real time properly and correctly adjusts each pulse-width signal for each injector immediately after the initiation of the injector pulse width signal but before the signal has ended. This is accomplished by outputting the signal AE/CS/-COMP to the pulse generating circuit 72 shown in FIG. 5. A timing diagram, FIG. 6, illustrated the operation of the pulse generator circuit of FIG. 5 and its response to the several inputs.

The microprocessor 10 is programmed to generate a signal called Beta Set which is gated 74 with the trigger system output to control one of the pulse time addition circuits 40 to actuate one of the injector drivers 46 to select the desired injector (INJ1 or INJ3). The Beta Set signal is connected through a pull-up resistor 76 to the output of an open collector comparator 78 and through a diode 80 to the non-inverting input of another open collector comparator 82. This input is also connected through a resistor 84 to $V_B$ from the fuel mapping circuit 36.

When the Beta Set signal goes to a logic zero voltage level, the diode 80 becomes reversed bias allowing $V_B$ to be applied to the input of the comparator 82. Since the inverting input is connected to the timing capacitor 86, which may have a charge thereon, the output transistor of the comparator 82 turns on discharging the capacitor 86. When the capacitor 86 voltage equals $V_B$, the comparator 82 operates to maintain the voltage on the capacitor 86 equal to $V_B$ until the Beta Set signal goes to a logic one level. When Beta Set is a logic zero, the output AND gate means 94 is disabled because the open-collector output of the comparator 78 is not biased hence, no fuel pulse is generated.

When the Beta Set signal goes to a logic one level the fuel pulse begins since the gate means 94 is enabled as the capacitor 86 is at a voltage lower than $V_{MAP}$. Concurrently, the non-inverting input of comparator 82 goes high since the diode 80 becomes forward biased and the output transistor of comparator 82 turns off allowing the capacitor 86 to charge at a rate determined by the current from transistor 88.

However, if the AE/CS/COMP signal from the microprocessor 10 goes to a logic one indicating that the pulse width is to be lengthened, the voltage compensation circuit 44 through an open collector output transistor connected to ground will ground the emitter of the current transistor 88 effectively turning off the transistor 88 and thereby not generating any charge current. Therefore, the voltage on capacitor 86 will remain at $V_B$ until the AE/CS/COMP signal goes to logic zero turning off the output transistor in the voltage compensation circuit 44. The AE/CS/COMP signal has the effect of adding an incremental width to the fuel pulse output from the comparator 78 by not charging the timing capacitor 86.

When the AE/CS/COMP signal goes to logic zero, the transistor 88 becomes forward biased and supplies the charge current to the timing capacitor 86. The amount of this current is determined by the alpha reference circuit 38 under control of the microprocessor 10 via the DAC output voltage $V_{DC}$ and the S/H signal from the microprocessor 10.

The alpha reference circuit 38 is a voltage to current converter which samples the input voltage, $V_{DC}$, when the analog switch 28 is closed by S/H equalling logic one and holds the last value of $V_{DC}$ when the analog switch 28 is opened when S/H equals logic zero. The holding of $V_{DC}$ is accomplished by the feedback capacitor 90 in the alpha reference circuit 38 which stores a charge equal to $V_{DC}$ which was received during the sample period.

Normally, the analog switch 28 is closed and the alpha reference circuit 38 establishes a constant current in transistor 92 as a function of $V_{DC}$ and is therefore under control of the microprocessor. This current is "mirrored" in the current transistor 88 to provide the charge current for the timing capacitor 86. As the microprocessor bus varies under control of the program, $V_{DC}$ will vary causing the capacitor charge current to change and therefore the fuel pulse width to vary.

When the microprocessor program requires the conversion of an analog input, the DAC must be used in conjunction with the comparators 30–33. At this time, the microprocessor puts the alpha reference circuit 38 into the hold mode by turning off the analog switch 28 with S/H equalling logic zero. The conversion of the analog input is then quickly performed by manipulating the bus and monitoring the comparator 30–33 desired.

During this time, the current sources are not changed since the alpha reference circuit "holds" the last $V_{DC}$ value. When the conversion has terminated the microprocessor 10 reestablishes the bus and therefore $V_{DC}$ and then puts the alpha reference circuit 38 back into the sample mode by closing the analog switch 28 with S/H equal to logic one.

Therefore, the DAC is multiplexed between performing analog to digital conversions and controlling the capacitor charge current through the alpha reference circuit.

As the capacitor 86 charges under control of the charge current from the transistor 88, the output of comparator 78 will remain at a high level until the capacitor voltage exceeds that of $V_{MAP}$. At this instant, the output transistor of the comparator 78 turns on terminating the pulse. The time duration of the resulting pulse can be expressed by the following equation:

$$P.W. = (V_{MAP} - V_B)\frac{C}{I} + T_O \quad (8)$$

Where:

$V_{MAP}$=the real time voltage output of the MAP sensor

C=capacitor value

I=the charge current established by the microprocessor through the DAC and reference circuits $T_O$=the real time incremented pulse calculated and timed by the microprocessor as a function of voltage compensation, acceleration enrichment or cold start enrichment (AE/CS/COMP).

Of the seven circuit variables in the pulse width equations (5) and (8), three are constants established by engine parameters and component values, one is a real time input and three are under direct control of the microprocessor providing the capability to combine the complex engine mapping advantages of digital technology with the real time advantages of analog circuits.

As the control capacitor 86 charges, the output of the comparator 78 supplies a pulse width signal to one input of an output gate means 94. This pulse width signal continues until the voltage inputs to the comparator 78 are equal. The output gate means is controlled by an inhibit signal from the microprocessor should the system not want a pulse width signal outputted to the injector drivers.

The output signal of gate means 94 is supplied to the dual injector driver circuit 46 for generating a power pulse actuating the injectors (INJ1 or INJ3).

We claim:

1. A fuel injection system with fuel mapping for energizing a plurality of fuel injectors for supplying controlled amounts of fuel to an engine, wherein said system comprises a plurality of sensors each sensing an engine operating condition and generating an electrical signal indicating said sensed operating condition, one of said sensors indicating manifold absolute pressure and another of said sensors indicating engine operating speed, a microprocessor adapted to receive said signals and operative in response thereto for generating a plurality of output signals including one or more digital words, a digital to analog converter receiving one of said digital words and operative to generate an analog voltage signal for generating a current control signal, pulse generating means responsive to the engine operating condition signals and the current control signal and operative to generate a pulse indicating actuation of an injector and having a pulse width proportional to the amount of fuel to be injected by the injector during the occurrence of said pulse, characterized by:

fuel mapping circuit means responsive to another one of said digital words from said microprocessor and to the signal indicating manifold pressure for generating an analog signal which is electrically connected to the pulse generating means and operative to cause the pulse width signal to be shortened in accordance with said another output digital word from the microprocessor and the manifold pressure at time of injection.

2. In the system according to claim 1 wherein the pulse generating means comprises a control capacitor means which is rapidly discharged to a discharge voltage level controlled by the said analog signal from said fuel mapping circuit means and is responsive to current control signal for charging at a predetermined rate, and comparator means for comparing the voltage charge on said capacitor means and the voltage indicating manifold pressure, to generate the pulse width signal.

3. In the system according to claim 1 or 2 wherein said fuel mapping circuit means comprises a multiplying digital to analog converter for multiplying the manifold pressure voltage with said another one of said digital words from the microprocessor.

4. In the system according to claim 3 additionally including an offset voltage generator electrically connected to the input of said fuel mapping circuit means for electrically moving the transfer function of fuel pulse width verses manifold pressure in accordance with the variables of the system by changing the input voltage to said fuel mapping circuit to be a function of the manifold pressure voltage and said offset voltage whereby said multiplying digital to analog converter is a differential multiplying digital to analog converter.

5. In the system according to claim 2 wherein said fuel mapping circuit means provides one of sixteen discharge voltage levels for said capacitor means representing the manifold pressure voltages inputted to said fuel mapping circuit means.

6. In the system according to claim 1 wherein the pulse generating means is a sequential injection pulse generating means generating pulses indicating the actuation sequence for each of the injectors.

* * * * *